US006268830B1

(12) United States Patent
Nakagawa et al.

(10) Patent No.: US 6,268,830 B1
(45) Date of Patent: Jul. 31, 2001

(54) ANTENNA AND ITS MANUFACTURING METHOD

(75) Inventors: Yoshinobu Nakagawa, Osaka; Yusuke Ishito, Okayama; Kazuji Ota; Susumu Inatsugu, both of Osaka, all of (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/330,613

(22) Filed: Jun. 11, 1999

(30) Foreign Application Priority Data

Jun. 15, 1998 (JP) ..... 10-166617

(51) Int. Cl.[7] ..... H01Q 1/24
(52) U.S. Cl. ..... 343/702; 343/901
(58) Field of Search ..... 343/702, 895, 343/725, 729, 906, 796, 769

(56) References Cited

U.S. PATENT DOCUMENTS

| | | | | |
|---|---|---|---|---|
| 4,647,936 | | 3/1987 | Taikawa . | |
| 5,177,493 | | 1/1993 | Tomura et al. . | |
| 5,703,602 | * | 12/1997 | Casebolt | 343/702 |
| 5,757,337 | * | 5/1998 | Hsueh et al. | 343/901 |
| 5,781,867 | * | 7/1998 | Tidwell | 455/575 |
| 5,793,331 | * | 8/1998 | Anzai et al. | 343/702 |
| 5,900,846 | * | 5/1999 | Phelps et al. | 343/901 |
| 5,995,064 | * | 11/1999 | Yanagisawa et al. | 343/895 |
| 6,031,493 | * | 2/2000 | Tsuda et al. | 343/702 |

* cited by examiner

*Primary Examiner*—Don Wong
*Assistant Examiner*—Chuc Trand
(74) *Attorney, Agent, or Firm*—Ratner & Prestia

(57) ABSTRACT

Preparations of piece parts used in coupling a joint and a feeding fixture together and the assembly work involved are made easy and a less expensive antenna can be realized. The antenna disclosed here includes a case of a wireless device, a holder mounted on the case, a first antenna element accommodated in the holder so as to be freely movable by sliding, a stopper coupled with one end of the first antenna element and connected electrically to the holder by sliding, a cylindrical column like joint formed of an insulating resin and fixed to the other end of the first antenna element, a tubular feeding fixture formed of a metal, electrically connected with the holder by sliding and put in place sheathing the joint, and a second antenna element electrically connected to one end of the feeding fixture. The feeding fixture has a pressing process applied portion formed by applying an inward pressing onto the peripheral thereof and the feeding fixture and the joint are coupled with each other at the pressing process applied portion. The manufacturing method of the antenna has the steps of putting in place the feeding fixture that sheathes the joint and applying an inward pressing process to the periphery of the feeding fixture, thereby coupling the joint and the feeding fixture together.

17 Claims, 8 Drawing Sheets

ANTENNA AND ITS MANUFACTURING METHOD

FIELD OF THE INVENTION

The present invention relates to an antenna and particularly relates to an antenna used in portable wireless devices such as portable telephones, PHS (Personal Handyphone System) and the like.

BACKGROUND OF THE INVENTION

In recent years, such portable wireless devices as portable telephones, PHS and the like are widely in use. These devices are equipped with an antenna for receiving and transmitting radio waves. This antenna is formed of a first antenna element that is made operative when the antenna is extended and a second antenna element that is made operative when the antenna is retracted into the wireless device's case for the convenience of portability.

A conventional type of the antenna as mentioned above will be described in the following with reference to FIG. 7 and FIG. 8:

FIG. 7 is a cross-sectional view of a prior art antenna.

In FIG. 7, the bottom end of a first antenna element 1 is coupled with a stopper 3 formed of an electrically conductive metal and the upper part of the first antenna element 1 is fixed to a cylindrical column like joint 4 formed of an insulating resin and provided with screw threads 4A around the periphery of its top end. In addition, a tube 2 formed of an insulating resin is used to cover the periphery of the first antenna element 1. The first antenna element 1 is formed of a linear metallic round wire.

A second antenna element 5 is formed of such an electrically conductive metal as copper, copper alloy or the like and structured like a coil winding. The second antenna element 5 is wound around a bobbin 6 formed of an insulating resin.

A feeding fixture 7 is formed of an electrically conductive metal.

The bottom end of the second antenna element 5 is attached to the top end of the feeding fixture 7 by winding around it, thereby completing an electrical connection therebetween.

A cover 8 formed of an insulating resin covers the periphery of the second antenna element 5. Screw threads 7A are formed inside of the bottom end of the feeding fixture 7 and the screw threads 4A of the joint 4 are screwed into the screw threads 7A with an adhesive applied for the prevention of loosening of the joint 4 due to its rotation.

An antenna insertion hole 9A and a spring insertion hole 9B are formed in the center of an antenna holder 9. Springs 10 contained in the spring insertion hole 9B are pressed against the stopper 3, which is coupled with the first antenna element 1, and kept parallel in position with the axis line of the stopper 3 by a spring action. A feeding nut 11 connected with electric circuits (not shown in FIG. 7) of a wireless device is tightened to screw threads 9C formed around the periphery of an antenna holder 9. The antenna holder 9 is fixed to the case 12 of the wireless device. The antenna holder 9 is formed of an electrically conductive metal. The springs 10 are also formed of an electrically conductive metal.

When the antenna is extended as shown in FIG. 7, the stopper 3 is brought into contact with the springs 10 contained in the antenna holder 9, which is attached to the case 12 of the wireless device, thereby enabling the first antenna element 1 connected electrically with the feeding nut 11 to transmit/receive radio waves via the antenna.

When the first antenna element 1 is retracted in the case 12 of the wireless device as shown in FIG. 8, the stopper 3 coupled with the first antenna element 1 is separated from the antenna holder 9 and the feeding fixture 7 is brought into contact with the springs 10 contained in the antenna holder 9, thereby enabling the second antenna element 5 connected electrically with the feeding nut 11 via the feeding fixture 7 to transmit/receive radio waves via the antenna.

However, since with the foregoing prior art antenna the coupling between the joint 4 fixed to the first antenna element 1 and the feeding fixture 7 connected with the second antenna element 5 is performed by screwing the screw threads 4A of the joint 4 into the screw threads 7A of the feeding fixture 7 with an adhesive applied thereto the cost of the molding process involved with the screw threads 4A of the joint 4 tends to become high and also the processing cost involved with cutting the screw threads 7A of the feeding fixture 7 and the like becomes expensive. Furthermore, controlling the position where an adhesive is applied and the amount of the adhesive applied between the screw threads 4A and the screw threads 7A is rather difficult.

In addition, the assembly work of the antenna is time consuming.

The present invention provides an antenna that facilitates the preparations of piece parts required in coupling the joint and the feeding fixture together and also the assembly work involved, resulting in less expense in time and effort and leading to realization of a less expensive antenna.

SUMMARY OF THE INVENTION

A manufacturing method for an antenna of the present invention includes the steps of:

providing a feeding fixture electrically connected to a second antenna element so as to sheathe a joint fixed to the end part of a first antenna element; and coupling the joint and the feeding fixture by applying an inward pressing process partially to the periphery of the feeding fixture.

An antenna of the present invention includes:

a first antenna element;

an electrically insulating joint fixed to one end of the first antenna element;

a feeding fixture formed of a metal put in place sheathing the joint; and a second antenna element electrically connected to one end of the feeding fixture, in which the feeding fixture has a pressing process applied portion, to the periphery of which an inward pressing is applied, and the feeding fixture and the joint are coupled with each other at the pressing process applied portion.

According to the above structure, preparations of the piece parts required in coupling the joint and the feeding fixture together and the assembly work involved with an antenna can be made easier and a less expensive antenna can be obtained.

KEY TO REFERENCE SYMBOLS

Figure 1:
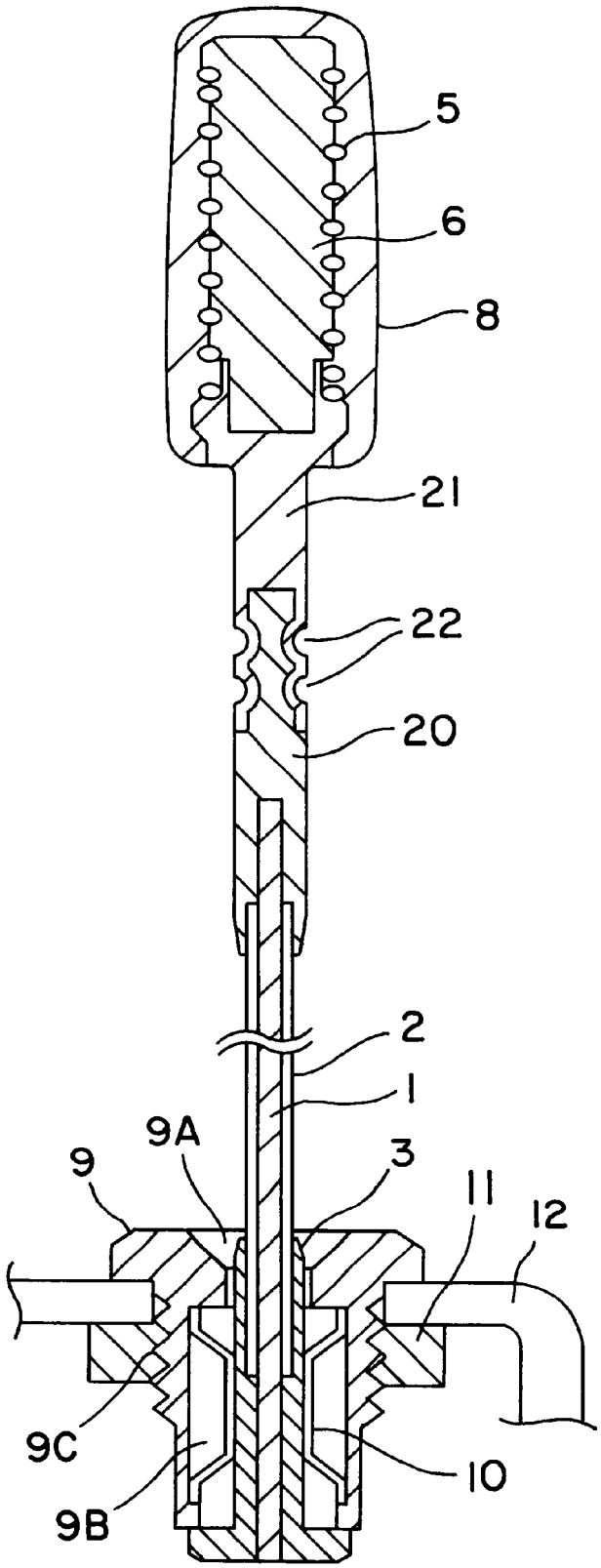
FIG. 1 is a cross-sectional view of an antenna in a first exemplary embodiment of the present invention.

1 First Antenna Element
2 Tube
3 Stopper
5 Second Antenna Element
6 Bobbin
8 Cover
9 Antenna Holder
9A Antenna Insertion Hole
9B Spring Insertion Hole
9C Screw Threads
10 Spring
11 Feeding Nut
12 Case
20 Joint
20A Protruded Section
20B Narrow Neck
21 Feeding Fixture
21A Hole
22, 25, 25A, 26 and 26A Indentations
23 Form Rolling Blade
24 Flat Platform
27 End Part

DETAILED DESCRIPTION OF THE INVENTION

An antenna in an exemplary embodiment of the present invention has:

a holder mounted on the case of a wireless device;

a stopper coupled with one end of a first antenna element, which is accommodated in the foregoing holder in such a way as freely movable by sliding and electrically connected with the holder according to the sliding motion of the first antenna element;

a cylindrical column like joint formed of an insulating resin and fixed to the other end of the first antenna element; and a tubular feeding fixture formed of a metal, the periphery of which sheathes the foregoing joint and is partially applied with an inward pressing process to couple with the joint and one end of which is electrically connected with a second antenna element, is electrically connected with the holder according to the sliding motion of the second antenna element.

The feeding fixture is put in place sheathing one end of the joint.

The periphery of the feeding fixture that sheathes the one end of the joint is applied with an inward pressing process, thereby having the joint and the feeding fixture coupled with each other. In other words, the foregoing feeding fixture has a portion applied with a pressing process, where the feeding fixture is pressed inward on its periphery and the feeding fixture and the joint are coupled with each other.

A manufacturing method of an antenna in an exemplary embodiment of the present invention includes the steps of:

(a) putting in place the feeding fixture to sheathe the joint; and (b) coupling the joint and the feeding fixture by applying an inward pressing process to the periphery of the feeding fixture with the feeding fixture positioned so as to sheathe the joint.

According to the above structure, preparations of the piece parts required in coupling the joint and the feeding fixture together and the assembly work involved with an antenna can be made easier and a less expensive antenna can be obtained.

Particularly preferred structures are as follows:

A first indentation is formed on the feeding fixture at the portion applied with a pressing process, a second indentation is formed on the surface of the joint at a position inside of the feeding fixture and the feeding fixture and the joint are coupled with each other by having the foregoing first indentation digged in the second indentation.

By means of a pressing process, at least one ring shaped indentation is formed on the periphery of a feeding fixture.

In other words, a ring shaped indentation is formed on the periphery of the feeding fixture as a result of applying a pressing process to the feeding fixture. By having this indentation digged in the resin of the joint, a secure coupling between the joint and the feeding fixture is achieved, thereby enabling the realization of a stabilized antenna.

By means of a pressing process, a spiral indentation of a predetermined length is provided on the periphery of a feeding fixture. The spiral indentation is formed asymmetrically with respect to the axis line of an antenna.

As a result, the strength against a pulling force applied in the direction of the axis line of the antenna is enhanced and also an intensified strength can be obtained in the bending direction that is orthogonal to the axis line.

A spiral indentation is formed so as not to reach the end part of a feeding fixture. The spiral indentation is formed only on the middle portion of the feeding fixture so as not to reach the end part of the feeding fixture. As a result, the strength against a pulling force due to a twist applied to the coupled portion is intensified.

By means of a pressing process, a plurality of spot like indentations of a predetermined size are formed on the periphery of a feeding fixture. The indentations are formed in a spot like form, not extending all over the periphery of the feeding fixture.

As a result, the overall dimensions of an antenna are made small and, even when the outer diameters of a joint and a feeding fixture are small, a secure coupling between the joint and the feeding fixture can be achieved without reducing the strength in the bending direction that is orthogonal to the axis line.

By means of a pressing process, the outer diameter of a feeding fixture at an opposing end is tapered off to have the end part of the feeding fixture engaged in the resin of a joint and slanted. As a result, a secure coupling between the joint and the feeding fixture is achieved. Furthermore, when an antenna is pushed down and retracted in an antenna holder mounted on a case of a wireless device, no feeling of sticking and the like is sensed and the antenna is retracted smoothly by sliding.

With a joint covered by a feeding fixture, the outer diameter of the joint at a portion corresponding to an opposing end of the feeding fixture is in advance made small when compared with other portions. As a result, the end part of the feeding fixture fits over the portion with the smaller diameter, thereby enabling the coupling between the joint and the feeding fixture to be achieved without requiring the end part of the feeding fixture to be engaged in the resin of the joint and making the assembly work for coupling easy.

Next, some of the exemplary embodiments of the present invention will be described with reference to FIG. 1 to FIG. 6.

Portions of a structure that has the same structure as described in the section relative to prior arts are assigned with the same symbols and detailed descriptions on such symbols are omitted.

First Exemplary Embodiment

FIG. 1 is a cross-sectional view of an antenna in a first exemplary embodiment of the present invention. In FIG. 1, a tube 2 formed of an insulating resin covers the periphery of a first antenna element 1 formed of a linear metallic round wire.

A stopper 3 formed of an electrically conductive metal is coupled to the bottom end of the first antenna element 1. A second antenna element 5, which is prepared by winding in a coil shape a wire made of an electrically conductive metal such as copper, copper alloy or the like, is wound around a bobbin 6 formed of an insulating resin. A cover 8 formed of an insulating resin covers the periphery of the second antenna element 5 wound around the bobbin 6. The structure of the antenna as described in the above is the same as the structure of a prior art antenna.

The first antenna element 1 is accommodated in an antenna insertion hole 9A located in the center of an antenna holder 9 formed of an electrically conductive metal in such a way as freely movable by sliding. A feeding nut 11, which is connected with electrical circuits (not shown in the drawing) of a wireless device, is screwed in the screw threads 9C formed around the periphery of the antenna holder 9, thereby mounting the antenna holder 9 on a case 12. Springs 10 formed of an electrically conductive metal plate are placed inside of a spring insertion hole 9B of the antenna holder 9 are brought into contact by a spring action with the stopper 3 that is coupled with the first antenna element 1. The above structure is the same as the structure employed in a prior art antenna. A cylindrical column like joint 20 formed of an insulating resin is fixed to the top end of the first antenna element 1. The bottom end of the second antenna element 5 is attached to the top end of a feeding fixture 21 by being wound. The bottom end of the feeding fixture 21 is put in place sheathing the joint 20. The joint 20 and the feeding fixture 21 are coupled with each other by means of two of a ring shaped indentation 22 formed by a process of an inward pressing applied partially to the periphery of the feeding fixture 21.

The method for forming the ring shaped indentations 22 will be described below with reference to FIG. 2(*a*) and FIG. 2(*b*).

The feeding fixture 21 is tubular in shape and formed of a metal that can form an indentation by applying a pressing process thereto. The joint 20 has a cylindrical column like shape and is formed of a resin that can form an indentation by the applying a pressing process thereto. First, as shown in FIG. 2(*a*), a protruded section 20A of the joint 20 is inserted in a hole 21A of the feeding fixture 21 connected electrically to the second antenna element 5, the protruded section 20A having a little smaller outer diameter than the inner diameter of the hole 21A. Then, as shown in FIG. 2(*b*), the feeding fixture 21 engaged with the joint 20 is held between a form rolling blade 23 and a flat platform 24 squarely and, while the form rolling blade 23 being pushed down, the feeding fixture 21 is moved back and forth and rotated, thereby applying a pressing process onto the periphery of the feeding fixture 21 in a spiral motion to form a pressing process applied section. At this pressing processed section, a ring shaped first indentation 22 is formed over the periphery of the feeding fixture 21 and at the same time a ring shaped second indentation is formed on the surface of the joint 20 also at a position inside of the first indentation 22. By having the first and second indentations formed in the pressing process applied section engaged with each other, the joint 20 and the feeding fixture 21 are coupled together.

Figure 3:
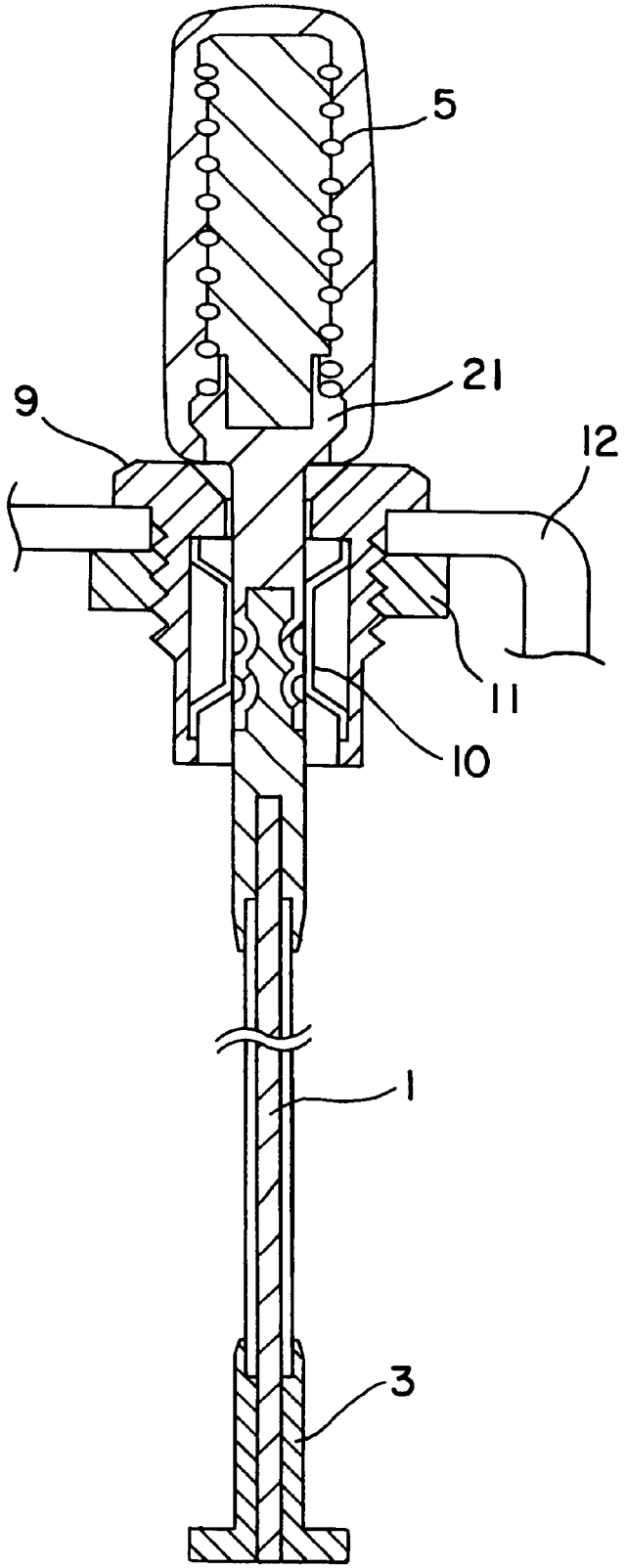
FIG. 3 is a cross-sectional view of the antenna in the first exemplary embodiment of the present invention when the antenna was retracted.

Under the condition where the antenna is extended as shown in FIG. 1, the stopper 3 comes into contact with the springs 10 accommodated in the antenna holder 9 that is mounted on the case 12 of the wireless device and the antenna transmits/receives radio waves via the first antenna element 1 electrically connected to the feeding nut 11. On the other hand, when the antenna element 1 is retracted inside of the case 12 of the wireless device as shown in FIG. 3, the stopper 3 coupled with the first antenna element 1 is pushed down into the wireless device and separated from the antenna holder 9 and the feeding fixture 21 comes into contact with the springs 10 accommodated in the antenna holder 9, thereby the antenna transmits/receives radio waves via the second antenna element 5 that is connected electrically to the feeding nut 11 through the feeding fixture 21.

Thus, according to the present exemplary embodiment, the feeding fixture 21 electrically connected with the second antenna element 5 is put in place sheathing the joint 20 fixed to the end part of the first antenna element 1 and the joint 20 and the feeding fixture 21 are coupled together by applying an inward pressing process partially onto the periphery of the feeding fixture 21.

Therefore, preparations of the piece parts required for coupling the joint 20 and the feeding fixture 21 together and the assembly work involved can be made easier, thereby enabling the realization of a less expensive antenna.

By means of a pressing process, the ring shaped indentation 22 is formed around the periphery of the feeding fixture 21 and this indentation 22 is digged in the resin of the joint 20, thus forming an engagement section. On account of the existence of this engagement section, a secure and stabilized coupling between the joint 20 and the feeding fixture 21 is assured.

It is also possible to form a plurality of ring shaped indentations 22 on the periphery of the feeding fixture 21.

In this case, the strength of the coupling is intensified. Furthermore, by changing the number of the indentations, the coupling strength can be varied arbitrarily.

Second Exemplary Embodiment

Figure 4A:
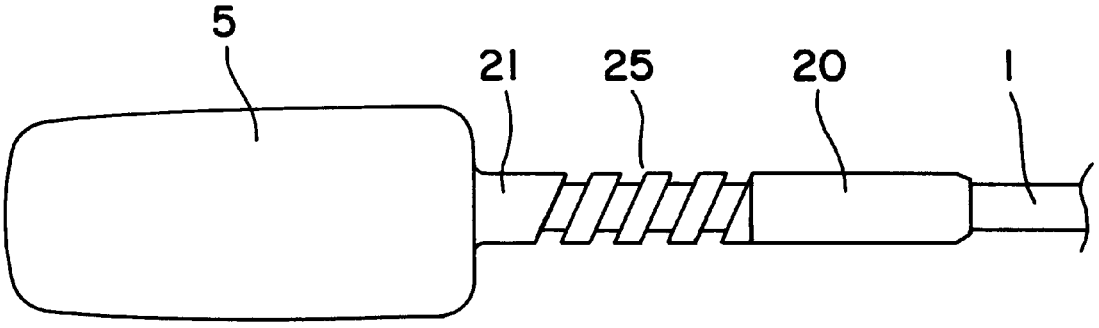
FIG. 4(*a*) and FIG. 4(*b*) are front views of an antenna in a second exemplary embodiment of the present invention.
Figure 4B:
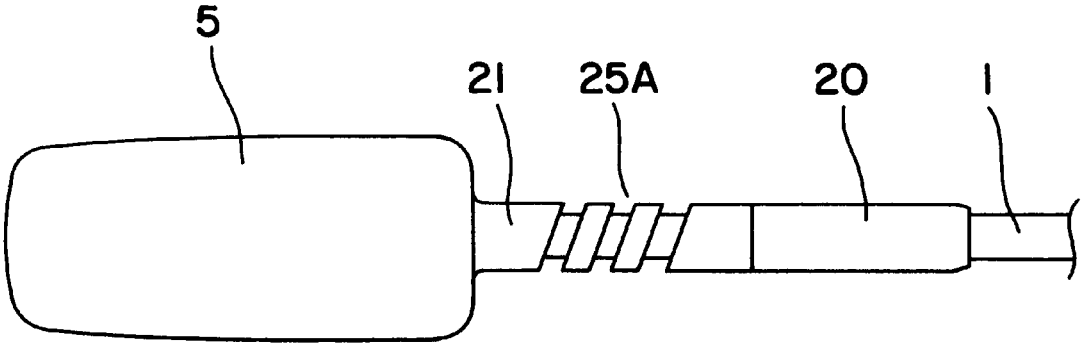

FIG. 4(*a*) is a front view of an antenna in a second exemplary embodiment of the present invention.

In FIG. 4(*a*), a feeding fixture 21 connected electrically with a second antenna element 5 is put in place sheathing a joint 20 that is fixed to the end part of a first antenna element 1. The joint 20 and the feeding fixture 21 are coupled together by means of an inward pressing process applied partially onto the periphery of the feeding fixture 21. Further, a spiral indentation 22 of a predetermined length is formed over the periphery of the feeding fixture 21.

Since the above indentation 25 is spiral in shape, the indentation 25 presents itself asymmetrical with respect to the axis line of the antenna. In this respect, the indentation 25 is different from the ring shaped indentation 22 of the first exemplary embodiment.

Figure 2A:
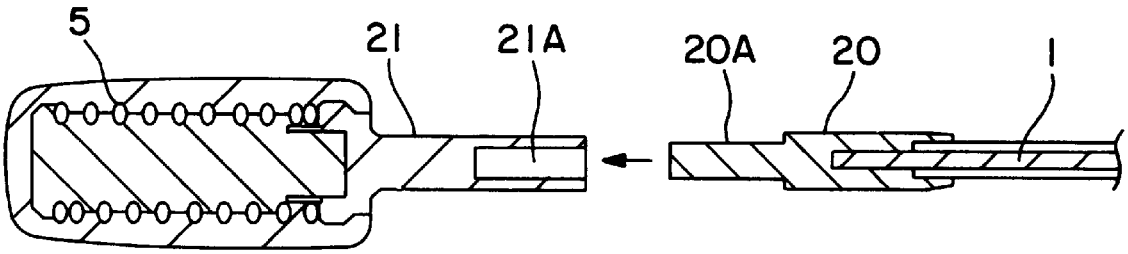
FIGS. 2*a* and 2*b* are a cross-sectional views of the antenna in the first exemplary embodiment of the present invention to describe the method for applying a pressing process.
Figure 2B:
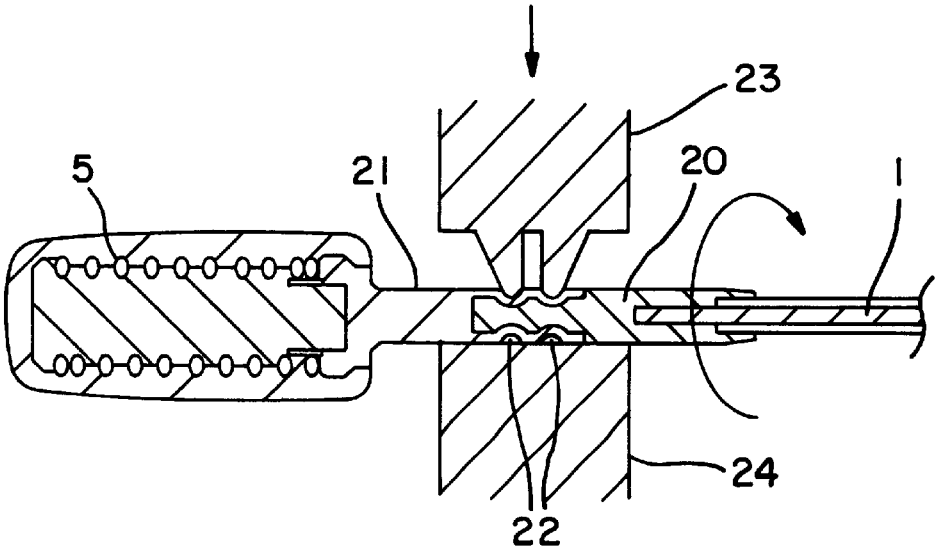

The method for forming the spiral indentation 25 will be described as follows:

In the case of forming the ring shaped indentation 22 of the first exemplary embodiment, the feeding fixture 21 combined with the joint 20 was placed squarely between the form rolling blade 23 and the flat platform 24 as shown in FIG. 2. In contrast, when the spiral indentation 25 of the present exemplary embodiment is formed, the feeding fixture 21 engaged with the joint 20 is placed between the form rolling blade 23 and the flat platform 24 slantingly and, by rotating the feeding fixture 21 while the form rolling blade 23 being moved linearly back and forth, the same processing as in the first exemplary embodiment can be employed.

Thus, according the present exemplary embodiment, a spiral indentation 25 with a predetermined length is formed around the periphery of the feeding fixture 21 by means of a pressing process and the joint 20 and the feeding fixture 21 are coupled together by the pressing stress due to the indentation 25.

Since the indentation 25 is asymmetrical with respect to the axis line of the antenna, an intensified strength can be created not only against a pulling force imposed in the axial direction of the antenna but also against a bending force imposed in the direction intersecting the axis line of the antenna at right angles.

When the pressing process is applied to the feeding fixture 21, it is also possible to employ a structure, in which an indentation is formed on the surface of the joint 20 at a position inside of the indentation 25. Further, it is also possible to employ a structure whereby the indentation of the feeding fixture 21 is engaged to the indentation of the joint 20, thus coupling the both together. In these cases, the coupling force that is exerted between the feeding fixture 21 and the joint 20 is further intensified. Although it is not usually likely to cause the feeding fixture 21 and the joint 20 easily to be separated from each other by an application of a twisting force as encountered with a screw, the strength against a pulling force caused by twisting can be further intensified by providing the spiral indentation 25A only in the middle section of the feeding fixture 21, not extending as far as the end thereof.

In addition, the strength of the coupling between the feeding fixture 21 and the joint 20 can be arbitrarily varied by altering the pitch and length of the spiral indentation 25 formed over the periphery of the feeding fixture 21.

Third Exemplary Embodiment

Figure 5A:
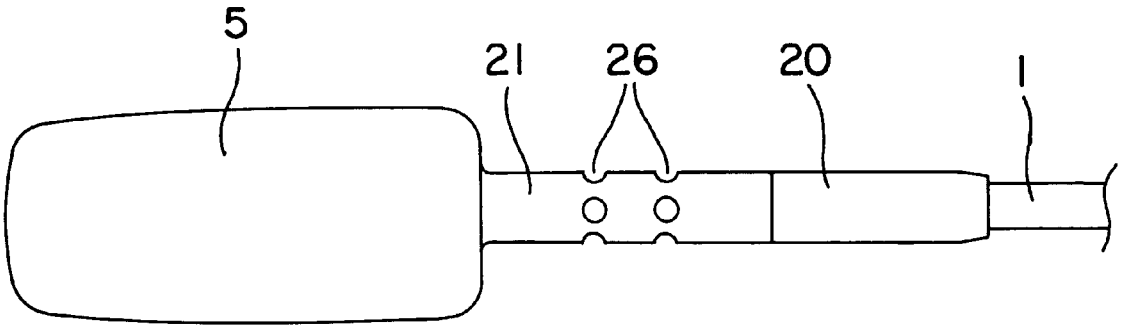
FIG. 5(*a*) and FIG. 5(*b*) are front views of an antenna in a third exemplary embodiment of the present invention.
Figure 5B:
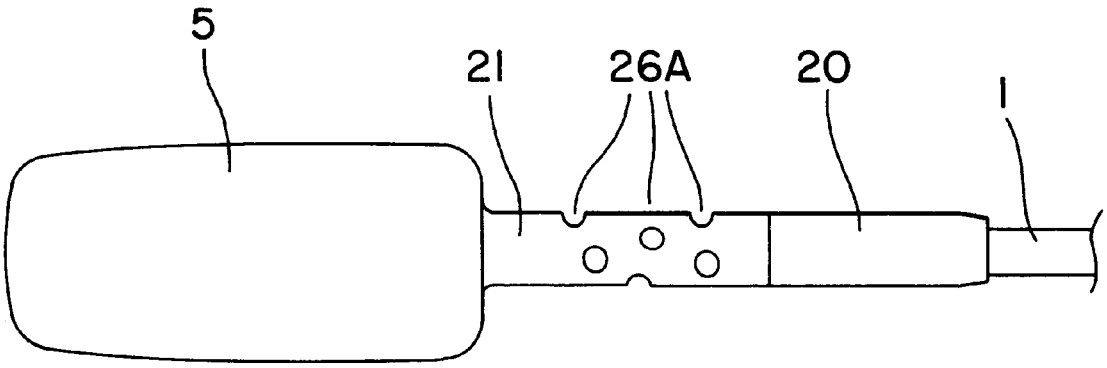

FIG. 5(*a*) is a front view of an antenna in a third exemplary embodiment of the present invention. In FIG. 5(*a*), a feeding fixture 21 electrically connected with a second antenna element 5 is put in place sheathing a joint 20 that is fixed to the end part of a first antenna element 1 and, by applying an inward pressing process partially to the periphery of the feeding fixture 21, the joint 20 and the feeding fixture 21 are coupled together. This structure is the same as the structure in the first exemplary embodiment except for the configuration of the place where the inward pressing process is applied to the periphery of the feeding fixture 21 that sheathes the joint 20.

In other words, a plurality of spot like indentations 26, each having a predetermined size, are formed on the periphery of the feeding fixture 21 at positions where an almost equal angle between adjoining positions is made against the center of the tubular feeding fixture 21.

According to the present exemplary embodiment, the indentations 26 are spot like in shape and not located all over the periphery of the feeding fixture 21, differing from the first exemplary embodiment, in which a ring shaped indentation 22 is formed all over the periphery of the feeding fixture 21 and also differing from the second exemplary embodiment, in which a spiral indentation 25 is formed. As a result, the antenna is made small as a whole and, even if the outer diameter of the joint 20 and feeding fixture 21 is small, a secure coupling between the joint 20 and the feeding fixture 21 can be achieved without reducing the strength against a bending force imposed in the direction intersecting the axis line of the antenna at right angles.

In addition, the strength of the coupling between the feeding fixture 21 and the joint 20 can be arbitrarily varied by altering the size and number of the spot like indentations 26 formed on the periphery of feeding fixture 21. It is also possible to employ a structure, in which spot like indentations 26A are formed on the periphery of the feeding fixture 21 randomly at a plurality of positions instead of on the same perimeter of the feeding fixture 21 as shown in FIG. 5(*b*). In this case, besides using the processing method of placing the feeding fixture 21 between the form rolling blade 23 and the flat platform 24 and moving linearly the form rolling blade 23 back and forth while rotating the feeding fixture 21 as described in the exemplary embodiments 1 and 2, the indentations 26A can be formed by means of a pressing process that uses an upper die and a lower die, each provided with projections corresponding to the spot like indentations 26A. According to the above structure, the processing facilities involved can be made simpler. In this exemplary embodiment also, spot like indentations are formed on the surface of the joint 20 situated inside of the feeding fixture 21, thereby creating the condition, in which the indentations of the feeding fixture 21 are engaged with the indentations of the joint 20. On account of the existence of this portion where the foregoing engagement takes place, the feeding fixture 21 and the joint 20 are coupled with each other.

Fourth Exemplary Embodiment

Figure 6A:
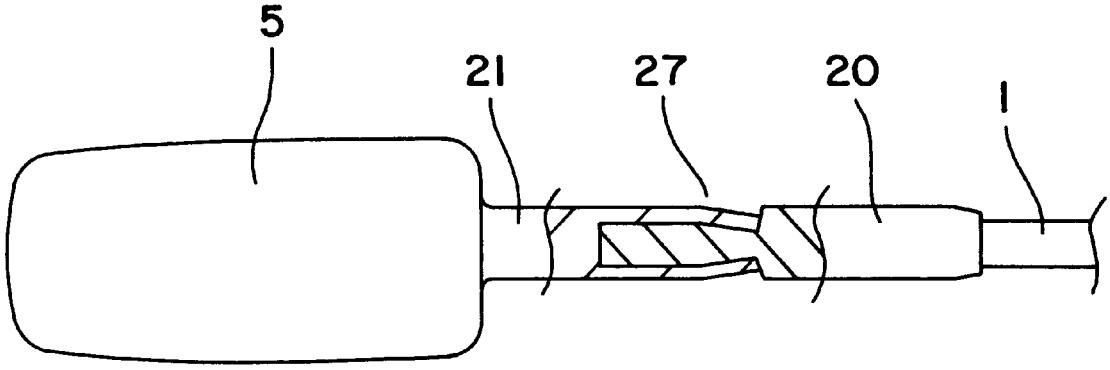
FIG. 6(*a*) and FIG. 6(*b*) are partially cross-sectional views of an antenna in a fourth exemplary embodiment of the present invention.
Figure 6B:
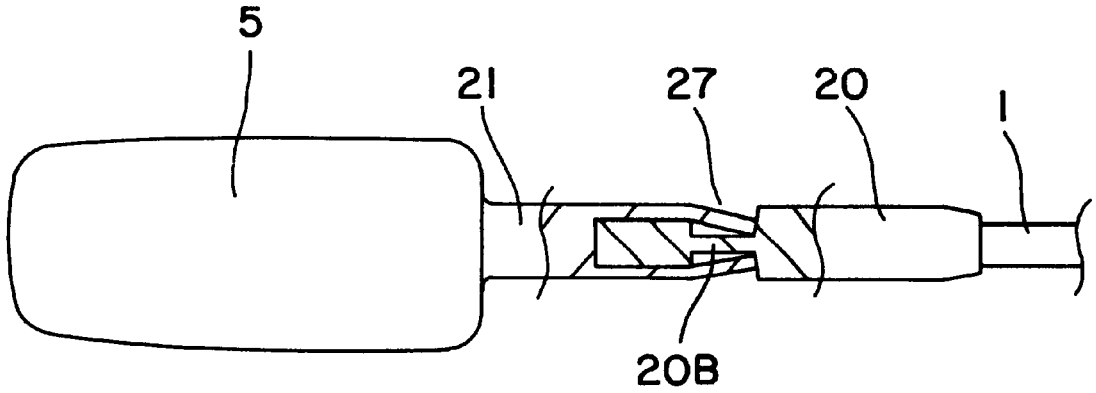
Figure 7:
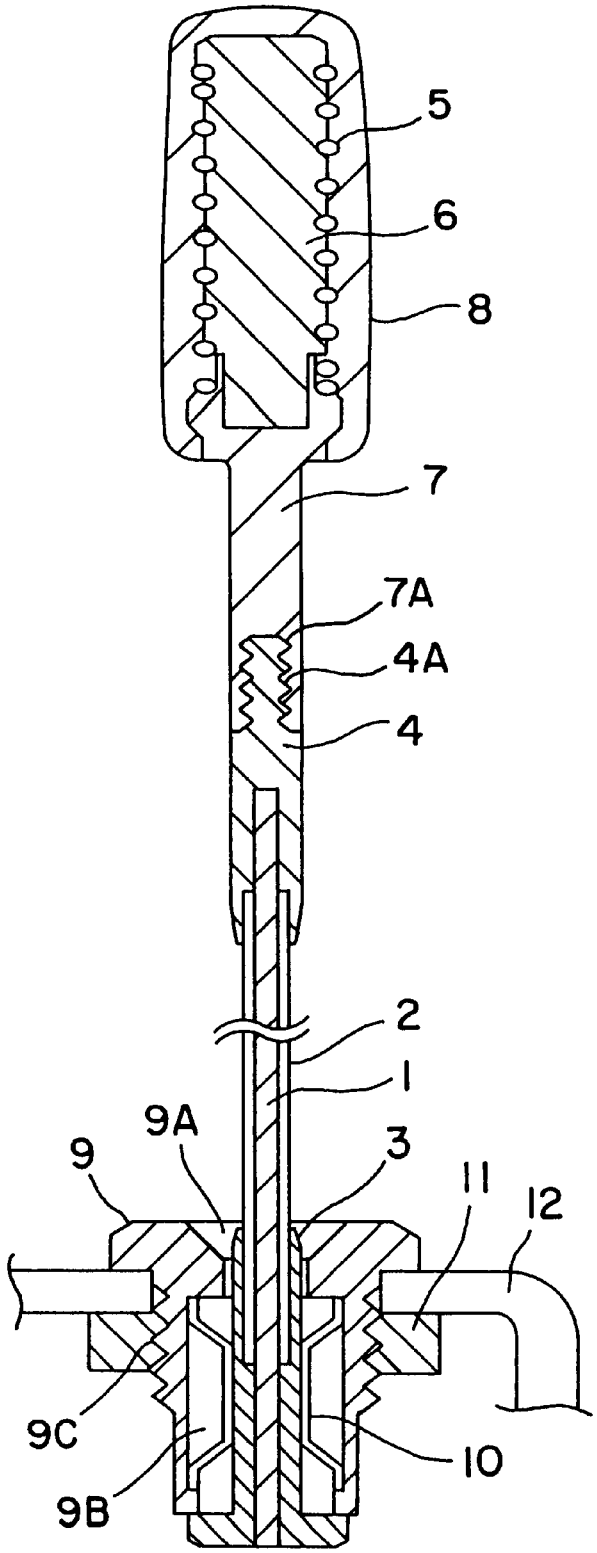
FIG. 7 PRIOR ART
FIG. 7 is a cross-sectional view of a prior art antenna.
Figure 8:
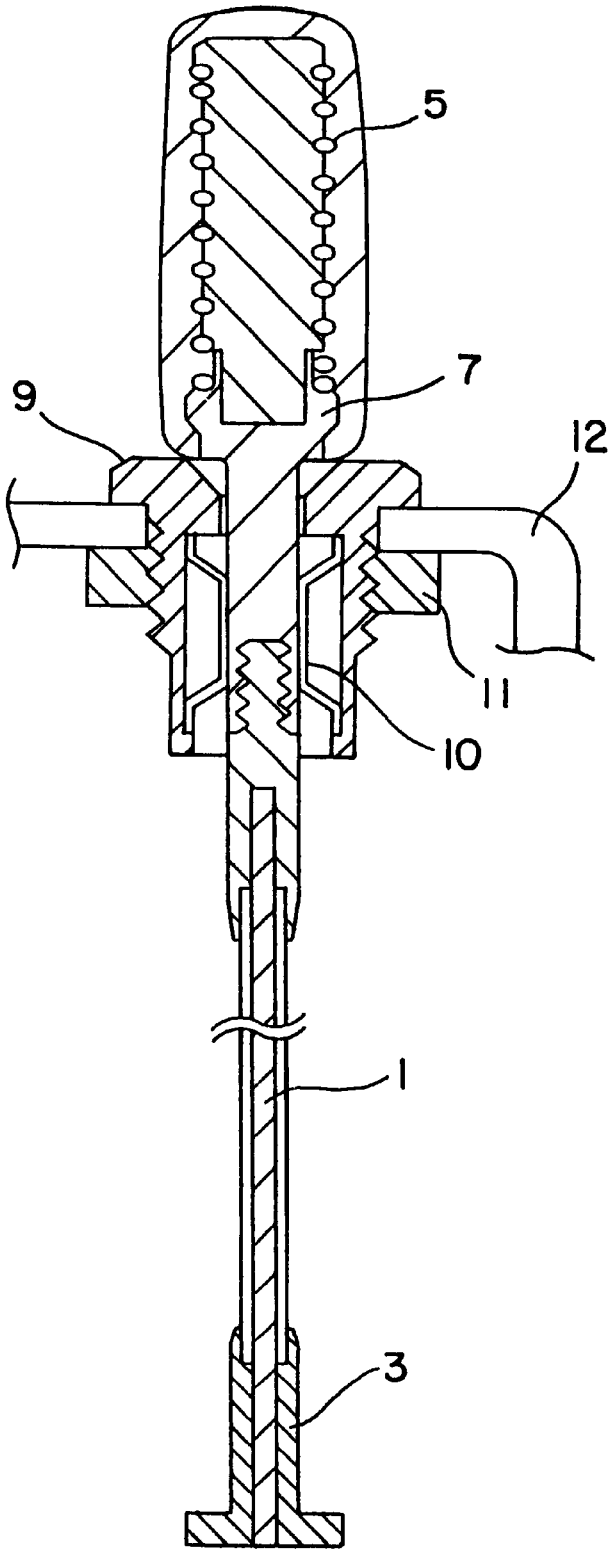
FIG. 8 PRIOR ART
FIG. 8 is a cross-sectional view of the prior art antenna when the antenna was retracted.

FIG. 6(*a*) is a partially cross-sectional view of an antenna in a fourth exemplary embodiment of the present invention.

In FIG. 6(*a*), a feeding fixture 21 electrically connected with a second antenna element 5 is put in place sheathing a joint 20 that is fixed to the end part of a first antenna element 1 and, by applying an inward pressing process partially to the periphery of the feeding fixture 21, the joint 20 and the feeding fixture 21 are coupled together. This structure is the same as the structure in the first exemplary embodiment except for the position where the inward pressing process is applied to the periphery of the feeding fixture 21 that sheathes the joint 20.

In other words, the end part 27 of the feeding fixture sheathing the joint 20 is applied with an inward pressing process on its periphery to have its diameter tapered off and then the end part 27 is engaged in the resin of the joint 20, thereby coupling the joint 20 and the feeding fixture 21 together.

Since an inward pressing process is applied to the periphery of the end part 27 of the feeding fixture 21 to have its diameter tapered off and the end part 27 is slanting to engage in the resin of the joint 20 according to the present exemplified embodiment, a secure coupling between the joint 20 and the feeding fixture 21 is achieved and at the same time, when an antenna is pushed down and retracted in an antenna holder mounted on a case of a wireless device, no feeling of sticking and the like is sensed and the antenna can be retracted smoothly by sliding.

As shown in FIG. 6(*b*), the portion of the joint 20 that corresponds to the end part 27 of the feeding fixture 21 is provided in advance with a section 20B that has a smaller diameter than other sections of the joint 20 and the end part 27 applied with a pressing process is engaged with the small diameter section 20B. As a result, the coupling between the joint 20 and the feeding fixture 21 is made further securely and successfully achieved without having the end part 27 of the feeding fixture engaged in the resin of the joint 20, thereby enabling the assembly work for the coupling to be performed easily.

As described in the above, the present invention makes it possible to prepare readily the piece parts needed in coupling a joint and a feeding fixture together and also to perform the assembly work involved easily and, furthermore, to produce a less costly antenna.

What is claimed is:

1. An antenna comprising:

a case of a wireless device;

a holder mounted on said case;

a first antenna element accommodated in said holder in such a way as freely movable by sliding;

a stopper coupled with one end of said first antenna element, said stopper may being electrically connected to said holder;

a cylindrical column like joint formed of an insulating resin, said joint being fixed to the other end of said first antenna element;

a tubular feeding fixture formed of a metal, said tubular feeding fixture being put in place sheathing said joint and may being electrically connected to said holder; and a second antenna element electrically connected to one end of said feeding fixture, wherein said feeding fixture has a pressing process applied portion where an inward pressing has been applied onto the periphery thereof, and said feeding fixture and said joint are coupled with each other at said pressing process applied portion.

2. The antenna according to claim 1, wherein said feeding fixture has a first indentation formed at said pressing process applied portion, and a second indentation is formed on a surface of said joint at a position inside of said feeding fixture, and said feeding fixture and said joint are coupled with each other by having said first indentation engaged in said second indentation.

3. The antenna according to claim 1, wherein said pressing process applied portion has at least one ring shaped indentation provided around a periphery of said feeding fixture.

4. The antenna according to claim 1, wherein said pressing process applied portion has at least one spiral indentation with a predetermined length provided on a periphery of said feeding fixture.

5. The antenna according to claim 4, wherein said spiral indentation is apart from an end part of said feeding fixture.

6. The antenna according to claim 1, wherein said pressing process applied portion has a plurality of spot like indentations of a predetermined size provided on a periphery of said feeding fixture.

7. The antenna according to claim 1, wherein said pressing process applied portion forms an outer diameter tapering off toward inside at an other end of said feeding fixture.

8. The antenna according to claim 7, wherein an outer diameter of said joint is smaller at a section, where an engagement with an other end of said feeding fixture takes place, than a diameter at other sections.

9. A manufacturing method of an antenna, said antenna comprising:

a holder mounted on a case;

a first antenna element accommodated in said holder in such a way as freely movable;

a stopper coupled with one end of said first antenna element, said stopper may being electrically connectable to said holder;

an electrically insulating joint fixed to an other end of said first antenna element;

a feeding fixture formed of a metal, said fixture being put in place sheathing said joint, said feeding fixture may being electrically connectable to said holder; and a second antenna element electrically connected to one end of said feeding fixture, said manufacturing method comprising the steps of:

(a) putting said feeding fixture in place sheathing said joint; and (b) applying an inward pressing process to a periphery of said feeding fixture while said feeding fixture being kept at a position so as to sheathe said joint.

10. The manufacturing method of an antenna according to claim 9, wherein at the step of said applying a pressing process, said feeding fixture has a first indentation formed therein and a second indentation is formed on a surface of said joint at a position inside of said feeding fixture, and said feeding fixture and said joint are coupled with each other by having said first indentation digged in said second indentation.

11. The manufacturing method of an antenna according to claim 9, wherein by said step of applying the pressing process at least one ring shaped first indentation is formed on a periphery of said feeding fixture, a second indentation is formed on a periphery of said joint at a position inside of said first indentation, and said joint and said feeding fixture are coupled with each other by having said first indentation and said second indentation engaged with each other.

12. The manufacturing method of an antenna according to claim 9, wherein in said step of applying the pressing process, a spiral first indentation is formed on a periphery of said feeding fixture, a second indentation is formed on a periphery of said joint at a position inside of said first indentation, and said joint and said feeding fixture are coupled with each other by having said first indentation and said second indentation engaged with each other.

13. The manufacturing method of an antenna according to claim 9, wherein in said step of applying the pressing process, a spot like first indentation is formed on a periphery of said feeding fixture and a second indentation is formed on a periphery of said joint at a position inside of said first indentation, and said joint and said feeding fixture are coupled with each other by having said first indentation and said second indentation engaged with each other.

14. The manufacturing method of an antenna according to claim 9, wherein at said step of applying the pressing process, a first configuration with a diameter thereof tapering off inward is formed on an end part of said feeding fixture and a second configuration with the diameter thereof tapering off inward is formed on a periphery of said joint at a position inside of said first configuration, and said joint and said feeding fixture are coupled with each other by having said first configuration and said second configuration engaged with each other.

15. The manufacturing method of an antenna according to claim 9, wherein said joint has an end part and a junction having an outer diameter of which is smaller than an outer diameter of said end part, said feeding fixture is put in place sheathing said end part and said junction, said feeding fixture has a configuration tapering off inward formed on a periphery of an end part thereof in said step of applying a pressing process, and said joint and said feeding fixture are coupled with each other by having said first indentation and said second indentation engaged with each other.

16. The manufacturing method of an antenna according to claim 9, wherein said step (b) includes the step of placing said feeding fixture, which sheathes said joint, between a form rolling blade and a flat platform squarely and applying said form rolling blade against said feeding fixture sheathing said joint while said feeding fixture being rotated, thereby a ring shaped first indentation is formed on a periphery of said feeding fixture, a second indentation is formed on a surface of said joint at a position inside of said first indentation, and said joint and said feeding fixture are coupled with each other by having said first indentation and said second indentation engaged with each other.

17. The manufacturing method of an antenna according to claim 9, wherein said step (b) includes the step of placing said feeding fixture, which sheathes said joint, between a form rolling blade and a flat platform slantingly and applying said form rolling blade against said feeding fixture sheathing said joint while said feeding fixture being rotated, thereby a spiral first indentation is formed on a periphery of said feeding fixture and a second indentation is formed on a surface of said joint at a position inside of said first indentation, and said joint and said feeding fixture are coupled with each other by having said first indentation and said second indentation engaged with each other.

* * * * *

UNITED STATES PATENT AND TRADEMARK OFFICE

CERTIFICATE OF CORRECTION

PATENT NO. : 6,268,830 B1 
DATED : July 31, 2001
INVENTOR(S) : Y. Nakagawa et al.

It is certified that error appears in the above-identified patent and that said Letters Patent is hereby corrected as shown below:

Title page,
Item [56], References Cited, delete "5,177,493" insert -- 5,177,492 --.

Column 9,
Line 32, delete "in such a way as" insert -- so that said first antenna element is --.
Line 34, after the word "stopper" delete "may being" and after the word "electrically" delete "connected" and insert -- connectable --.
Line 41, between the words "place" and "sheathing" insert -- by --.
Line 41, after the words "joint and" delete "may being" and after the word "electrically" delete "connected" and insert -- connectable --.
Line 46, after the word "pressing" insert -- force --.

Column 10,
Line 21, delete "such a way as" and insert -- so that said first antenna element is --.
Line 23, after the word "stopper" delete "may being".
Line 28, between the words "place" and "sheathing" insert -- by --.
Line 34, between the words "place and sheathing" insert -- by --.
Line 38, after the word "fixture" delete "being" and insert -- is --.

Signed and Sealed this

Third Day of December, 2002

JAMES E. ROGAN
*Director of the United States Patent and Trademark Office*